US012800154B2

(12) United States Patent
Chellappan

(10) Patent No.: US 12,800,154 B2
(45) Date of Patent: Nov. 17, 2026

(54) VENTILATION SYSTEMS FOR DOMESTIC APPLIANCES AND METHODS FOR OPERATING THE SAME

(71) Applicant: Haier US Appliance Solutions, Inc., Wilmington, DE (US)

(72) Inventor: Bagawathkumar Chellappan, Prospect, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 387 days.

(21) Appl. No.: 18/469,979

(22) Filed: Sep. 19, 2023

(65) Prior Publication Data

US 2025/0093048 A1 Mar. 20, 2025

(51) Int. Cl.
*F24C 15/20* (2006.01)

(52) U.S. Cl.
CPC ..... *F24C 15/2021* (2013.01); *F24C 15/2042* (2013.01)

(58) Field of Classification Search
CPC ..... F24F 2110/10; F24F 2110/20; F24F 2110/66; F24F 2110/70; F24F 2110/72; F24F 11/001; F24C 15/2021; F24C 15/2042
See application file for complete search history.

(56) References Cited

U.S. PATENT DOCUMENTS

| | | | | |
|---|---|---|---|---|
| 7,866,312 | B2 * | 1/2011 | Erdmann | F24C 15/2042 126/299 F |
| 8,734,210 | B2 * | 5/2014 | Burdett | F24F 11/63 126/299 F |
| 9,677,772 | B2 | 6/2017 | Siegel et al. | |
| 10,982,869 | B2 | 4/2021 | Fang et al. | |
| 2009/0048714 | A1 * | 2/2009 | Hanawalt | F24C 15/2021 126/299 D |
| 2022/0113034 | A1 | 4/2022 | Moore et al. | |
| 2022/0136717 | A1 | 5/2022 | Wenger et al. | |
| 2022/0154954 | A1 | 5/2022 | Sinur et al. | |
| 2023/0280043 | A1 * | 9/2023 | Lee | F24F 11/0001 |

FOREIGN PATENT DOCUMENTS

| | | | | |
|---|---|---|---|---|
| CN | 110631095 A | | 12/2019 | |
| CN | 111012191 A | * | 4/2020 | A47J 27/00 |

* cited by examiner

*Primary Examiner* — Ngoc T Nguyen
(74) *Attorney, Agent, or Firm* — Dority & Manning, P.A.

(57) ABSTRACT

A ventilation system includes a casing defining a receiving space and an air outlet; an air handler positioned within the casing and configured to motivate an airflow through the air outlet to condition a room; and a controller operably coupled with the air handler, the controller configured to perform an operation. The operation includes detecting a plurality of characteristics of ambient air within the room; determining that at least one characteristic of the plurality of characteristics is outside of a predetermined range; emitting a notification to a user in response to determining that the at least one characteristic is outside of the predetermined range, wherein the notification includes a recommendation to perform a conditioning cycle; and receiving a command to initiate the conditioning cycle, wherein the conditioning cycle includes activating the air handler.

17 Claims, 4 Drawing Sheets

VENTILATION SYSTEMS FOR DOMESTIC APPLIANCES AND METHODS FOR OPERATING THE SAME

FIELD OF THE INVENTION

The present subject matter relates generally to ventilation systems, and more particularly to operating ventilation systems according to recommendations.

BACKGROUND OF THE INVENTION

Many households contain systems or assemblies for providing air circulation or ventilation to select rooms or areas. For instance, kitchen appliances such as ovens, microwaves, cooktops, or the like include ventilation systems, such as range hoods to selectively circulate air through the kitchen during or after cooking operations. Moreover, many bathrooms include circulation fans to reduce humidity or condition the air within the bathroom. Additional or alternative appliances may include circulation or ventilation systems, which typically include an air handler and one or more control systems.

However, existing ventilation systems and applications have certain drawbacks. For one example, a user is required to manually activate the air handler to initiate a ventilation cycle or operation. Accordingly, the ventilation cycle may not be performed during times when air quality is low, due to a lack of recognition from the user. For another example, some existing ventilation systems are activated automatically according to a preset trigger. Accordingly, the ventilation cycle may be performed unnecessarily, resulting in discomfort due to noise or a waste of electricity.

Accordingly, a ventilation system which obviates one or more of the above-mentioned drawbacks would be beneficial. In particular, a ventilation system including finely tuned activation points and user interaction would be useful.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a ventilation system is provided. The ventilation system may include a casing defining a receiving space and an air outlet; an air handler positioned within the casing and configured to motivate an airflow through the air outlet to condition a room; and a controller operably coupled with the air handler, the controller configured to perform an operation. The operation may include detecting a plurality of characteristics of ambient air within the room; determining that at least one characteristic of the plurality of characteristics is outside of a predetermined range; emitting a notification to a user in response to determining that the at least one characteristic is outside of the predetermined range, wherein the notification includes a recommendation to perform a conditioning cycle; and receiving a command to initiate the conditioning cycle, wherein the conditioning cycle includes activating the air handler.

In another exemplary aspect of the present disclosure, a method of operating a ventilation system provided within a room is provided. The ventilation system may include a casing and an air handler positioned within the casing. The method may include detecting a plurality of characteristics of ambient air within the room; determining that at least one characteristic of the plurality of characteristics is outside of a predetermined range; emitting a notification to a user in response to determining that the at least one characteristic is outside of the predetermined range, wherein the notification includes a recommendation to perform a conditioning cycle; and receiving a command to initiate the conditioning cycle, wherein the conditioning cycle includes activating the air handler.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
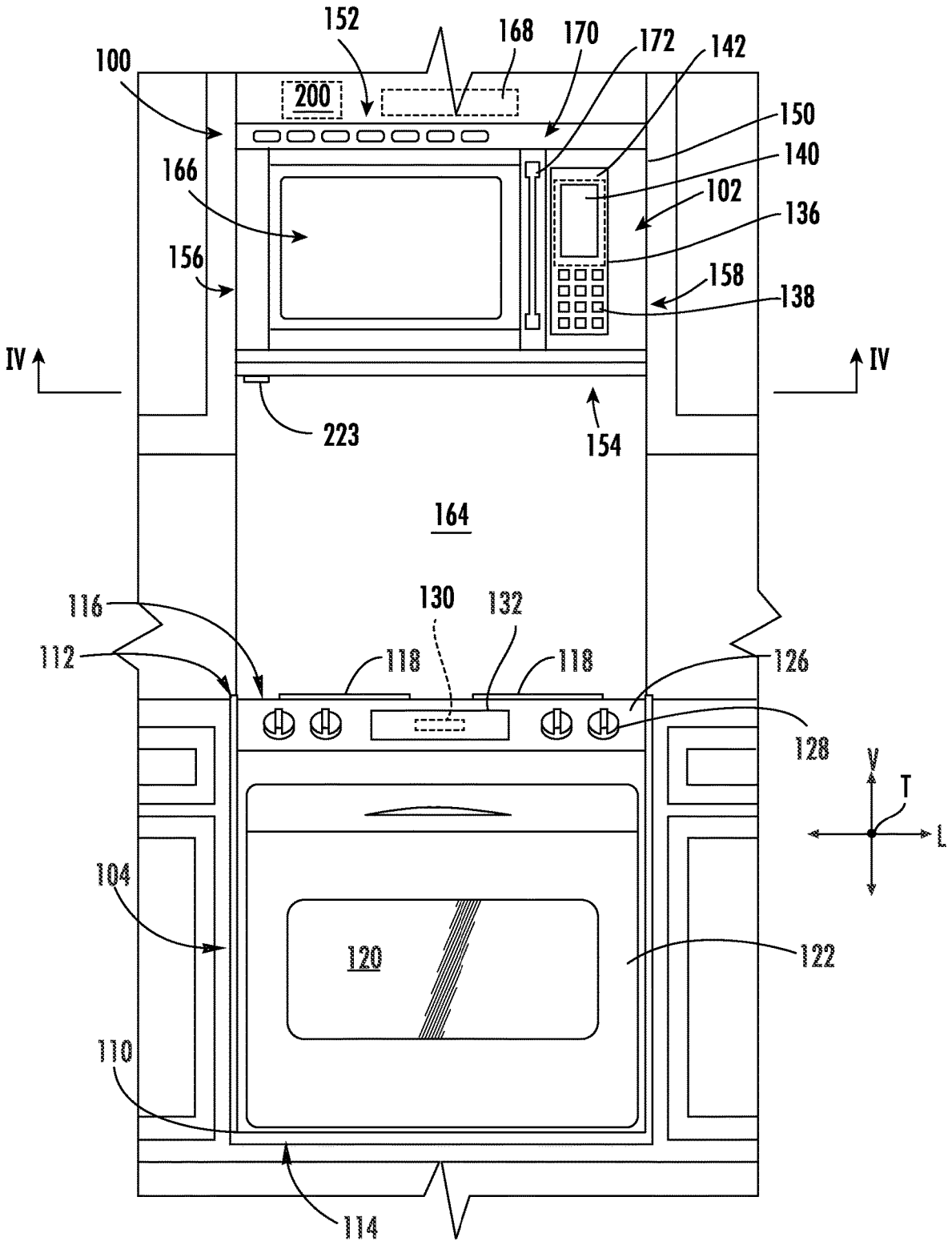
FIG. 1 provides a front view of a system, including an over the range microwave appliance, in accordance with an embodiment of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Embodiments of the present disclosure are referenced throughout this document with regard to an over the range (OTR) microwave with a ventilation system. The reference to a microwave is for illustration, not limitation. Any appliance, for example a kitchen appliance, may be paired with a ventilation system to yield an over the range kitchen appliance in accordance with this disclosure. For example, a radiant heat oven, a combination cooking mode oven, or a communications or entertainment hub may be paired with a ventilation system without departing the scope of this disclosure. Additionally or alternatively, the ventilation system described herein may be incorporated into any suitable application. For instance, a bathroom fan and circulation system, a washing machine ventilation system, an air conditioner appliance, or the like may utilize the ventilation system described herein, and the disclosure is not limited to the examples provided herein.

Turning to the figures, FIG. 1 provides a front view of a kitchen hub 100 according to exemplary embodiments of the present disclosure. Kitchen hub 100 may generally include an over-the-range (OTR) microwave appliance 102 that can be positioned or mounted above a cooktop appliance or range 104. However, it should be appreciated that the present subject matter is not limited to the specific appliances disclosed, and the specific appliance configurations are not intended to limit the scope of the present subject matter in any manner.

As shown in FIG. 1, kitchen hub 100 defines a vertical direction V, a lateral direction L, and a transverse direction T. The vertical, lateral, and transverse directions are mutually perpendicular and form an orthogonal direction system. As used herein, this coordinate system applies equally to both microwave appliance 102 and range 104 and will thus be used interchangeably to describe both appliances and their positions relative to each other.

Range 104 may include a chassis or cabinet 110 that extends along the vertical direction V between a top portion 112 and a bottom portion 114; along the lateral direction L between a left side portion and a right side portion; and along the traverse direction T between a front portion and a rear portion. Range 104 may include a cooktop surface 116 having one or more heating elements 118 (two shown) for use in, for example, heating or cooking operations. In exemplary embodiments, cooktop surface 116 is constructed with ceramic glass. In other embodiments, however, cooktop surface 116 may include another suitable material, such as a metallic material (e.g., steel) or another suitable non-metallic material. Heating elements 118 may be various sizes and may employ any suitable method for heating or cooking an object, such as a cooking utensil (not shown), and its contents.

In some embodiments, range 104 includes an insulated cabinet 110 that defines a cooking chamber 120 selectively covered by a door 122. One or more heating elements (not shown, e.g., top broiling elements or bottom baking elements) may be enclosed within cabinet 110 to heat cooking chamber 120. Heating elements within cooking chamber 120 may be provided as any suitable element for cooking the contents of cooking chamber 120, such as an electric resistive heating element, a gas burner, a microwave element, a halogen element, etc. Thus, cooktop appliance 104 may be referred to as an oven range appliance. As will be understood by those skilled in the art, cooktop appliance or range 104 is provided by way of example only, and the present subject matter may be used in the context of any suitable cooking appliance, such as a double oven range appliance or a standalone cooktop (e.g., fitted integrally with a surface of a kitchen counter). Thus, the example embodiments illustrated in figures are not intended to limit the present subject matter to any particular cooking chamber or heating element configuration, except as otherwise indicated.

As illustrated, a user interface (or user interface panel) 126 may be provided on range 104. Although shown at front portion of range 104, another suitable location or structure (e.g., a backsplash) for supporting user interface panel 126 may be provided in alternative embodiments. In some embodiments, user interface panel 126 includes input components or controls 128, such as one or more of a variety of electrical, mechanical, or electro-mechanical input devices. Controls 128 may include, for example, rotary dials, knobs, push buttons, and touch pads. A controller 130 is in communication with user interface panel 126 and controls 128 through which a user may select various operational features and modes and monitor progress of range 104. In additional or alternative embodiments, user interface panel 126 includes a display component 132, such as a digital or analog display in communication with a controller 130 and configured to provide operational feedback to a user. In certain embodiments, user interface panel 126 represents a general purpose I/O ("GPIO") device or functional block.

As shown, controller 130 is communicatively coupled (i.e., in operative communication) with user interface panel 126, controls 128, and display 132. Controller 130 may also be communicatively coupled with various operational components of range 104 as well, such as heating elements (e.g., 118), sensors, etc. Input/output ("I/O") signals may be routed between controller 130 and the various operational components of range 104. Thus, controller 130 may selectively activate and operate these various components. Various components of range 104 are communicatively coupled with controller 130 via one or more communication lines such as, for example, conductive signal lines, shared communication busses, or wireless communications bands.

In some embodiments, controller 130 includes one or more memory devices and one or more processors. The processors can be any combination of general or special purpose processors, CPUs, or the like that can execute programming instructions or control code associated with operation of range 104. The memory devices (i.e., memory) may represent random access memory such as DRAM or read only memory such as ROM or FLASH. In one embodiment, the processor executes programming instructions stored in memory. The memory may be a separate component from the processor or may be included onboard within the processor. Alternatively, controller 130 may be constructed without using a processor, for example, using a combination of discrete analog or digital logic circuitry (such as switches, amplifiers, integrators, comparators, flip-flops, AND gates, and the like) to perform control functionality instead of relying upon software.

In certain embodiments, controller 130 includes a network interface such that controller 130 can connect to and communicate over one or more networks with one or more network nodes. Controller 130 may also include one or more transmitting, receiving, or transceiving components for transmitting/receiving communications with other devices communicatively coupled with range 104. Additionally, or alternatively, one or more transmitting, receiving, or transceiving components can be located off board controller 130. Generally, controller 130 may be positioned in any suitable location throughout range 104. For example, controller 130 may be located proximate to user interface panel 126 toward front portion of range 104. In optional embodiments, controller 130 is in operable communication with a controller 130 (described below) of microwave appliance 102 (e.g., through one or more wired or wireless channels).

Referring still to FIG. 1, OTR microwave appliance 102 may include a control panel 136 that may represent a general-purpose Input/Output ("GPIO") device or functional block for microwave appliance 102. In some embodiments, control panel 136 may include or be in operative communication with one or more user input devices 138, such as one or more of a variety of digital, analog, electrical, mechanical, or electro-mechanical input devices including rotary dials, control knobs, push buttons, toggle switches, selector switches, and touch pads. Additionally, microwave appliance 102 may include a display 140, such as a digital or analog display device generally configured to provide visual feedback regarding the operation of microwave appliance 102. For example, display 140 may be provided on control panel 136 and may include one or more status lights, screens, or visible indicators. According to exemplary embodiments, user input devices 138 and display 140 may be integrated into a single device, e.g., including one or more of a touchscreen interface, a capacitive touch panel, a liquid crystal display (LCD), a plasma display panel (PDP), a cathode ray tube (CRT) display, or other informational or interactive displays.

Microwave appliance 102 may further include or be in operative communication with a processing device or a controller 142 that may be generally configured to facilitate appliance operation. In this regard, control panel 136, user input devices 138, and display 140 may be in communication with controller 142 such that controller 142 may receive control inputs from user input devices 138, may display information using display 140, and may otherwise regulate operation of microwave appliance 102. For example, signals generated by controller 142 may operate microwave appliance 102, including any or all system components, subsystems, or interconnected devices, in response to the position of user input devices 138 and other control commands. Control panel 136 and other components of microwave appliance 102 may be in communication with controller 142 via, for example, one or more signal lines or shared communication busses. In this manner, Input/Output ("I/O") signals may be routed between controller 142 and various operational components of microwave appliance 102.

As used herein, the terms "processing device," "computing device," "controller," or the like may generally refer to any suitable processing device, such as a general or special purpose microprocessor, a microcontroller, an integrated circuit, an application specific integrated circuit (ASIC), a digital signal processor (DSP), a field-programmable gate array (FPGA), a logic device, one or more central processing units (CPUs), a graphics processing units (GPUs), processing units performing other specialized calculations, semiconductor devices, etc. In addition, these "controllers" are not necessarily restricted to a single element but may include any suitable number, type, and configuration of processing devices integrated in any suitable manner to facilitate appliance operation. Additionally or alternatively, controller 142 may be constructed without using a microprocessor, e.g., using a combination of discrete analog and/or digital logic circuitry (such as switches, amplifiers, integrators, comparators, flip-flops, AND/OR gates, and the like) to perform control functionality instead of relying upon software.

Controller 142 may include, or be associated with, one or more memory elements or non-transitory computer-readable storage mediums, such as RAM, ROM, EEPROM, EPROM, flash memory devices, magnetic disks, or other suitable memory devices (including combinations thereof). These memory devices may be a separate component from the processor or may be included onboard within the processor. In addition, these memory devices can store information and/or data accessible by the one or more processors, including instructions that can be executed by the one or more processors. It should be appreciated that the instructions may be software written in any suitable programming language or can be implemented in hardware. Additionally, or alternatively, the instructions may be executed logically and/or virtually using separate threads on one or more processors.

For example, controller 142 may be operable to execute programming instructions or micro-control code associated with an operating cycle of appliance 102. In this regard, the instructions may be software or any set of instructions that when executed by the processing device, cause the processing device to perform operations, such as running one or more software applications, displaying a user interface, receiving user input, processing user input, etc. Moreover, it should be noted that controller 142 as disclosed herein is capable of and may be operable to perform any methods, method steps, or portions of methods as disclosed herein. For example, in some embodiments, methods disclosed herein may be embodied in programming instructions stored in the memory and executed by controller 142.

The memory devices may also store data that can be retrieved, manipulated, created, or stored by the one or more processors or portions of controller 142. The data can include, for instance, data to facilitate performance of methods described herein. The data can be stored locally (e.g., on controller 142) in one or more databases and/or may be split up so that the data is stored in multiple locations. In addition, or alternatively, the one or more database(s) can be connected to controller 142 through any suitable network(s), such as through a high bandwidth local area network (LAN) or wide area network (WAN). In this regard, for example, controller 142 may further include a communication module or interface that may be used to communicate with one or more other component(s) of microwave appliance 102, controller 142, an external appliance controller, or any other suitable device, e.g., via any suitable communication lines or network(s) and using any suitable communication protocol. The communication interface can include any suitable components for interfacing with one or more network(s), including for example, transmitters, receivers, ports, controllers, antennas, or other suitable components.

As noted above, microwave appliance 102 may be positioned or mounted above range 104 (e.g., as an OTR microwave). Specifically, a cabinet 150 of OTR microwave appliance 102 may be positioned above range 104 along the vertical direction V.

Figure 3:
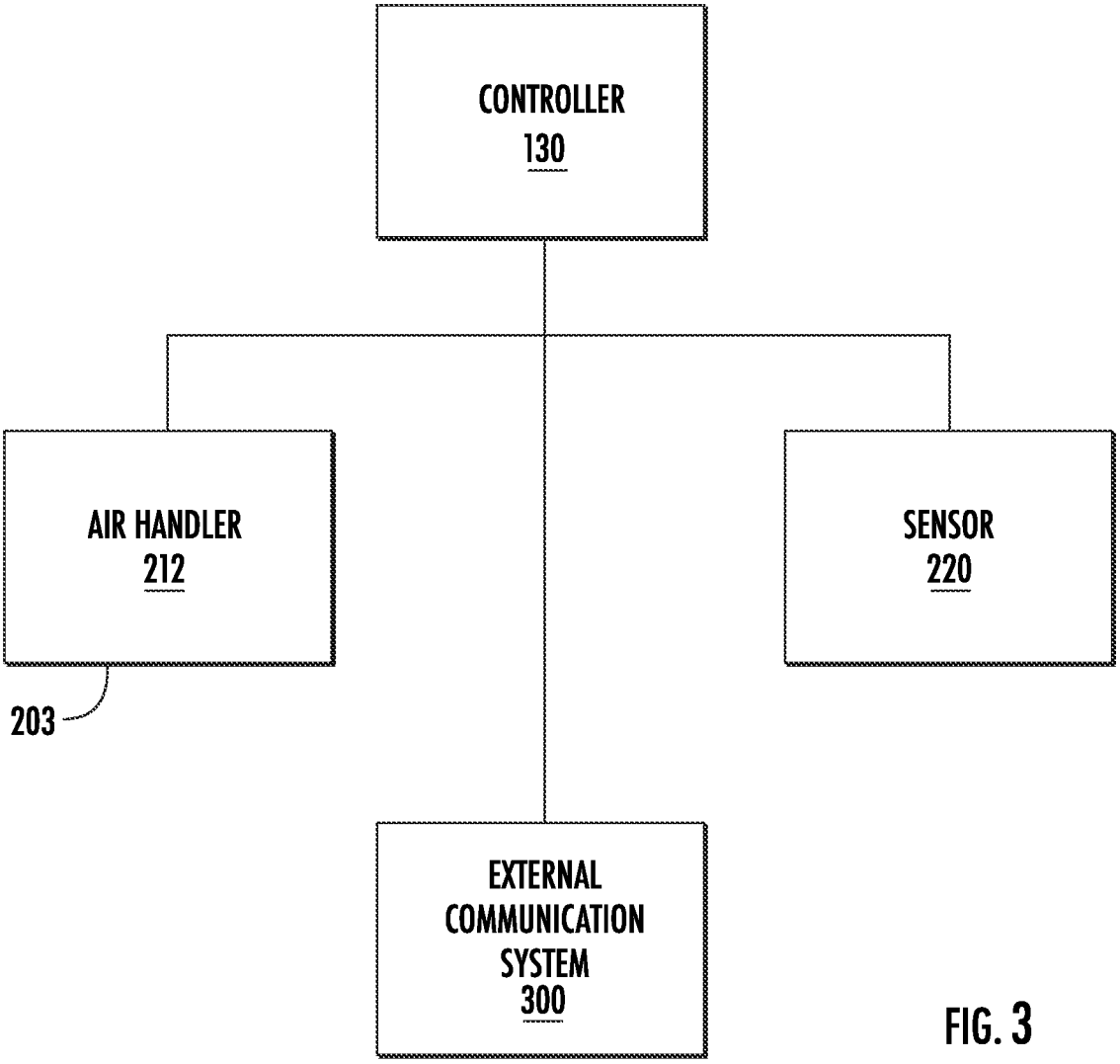
FIG. 3 provides a schematic diagram including elements of an appliance according to exemplary embodiments of the present disclosure.

In embodiments, the cabinet 150 may be an insulated cabinet. As shown, cabinet 150 of microwave appliance 102 includes a plurality of outer walls and when assembled, microwave appliance 102 generally extends along the vertical direction V between a top end 152 and a bottom end 154; along the lateral direction L between a first side end 156 and a second side end 158; and along the transverse direction T between a front end and a rear end. In particular, cabinet 150 comprises first exterior side panel 176 at first side 156 laterally spaced from second external side panel 178 at second side 158, a front panel 180, a back panel 182, and a top panel 184 (FIG. 3).

In some embodiments, cabinet 150 is spaced apart from cooktop surface 116 along the vertical direction V. An open region 164 may thus be defined along the vertical direction V between cooktop surface 116 and bottom end 154 of cabinet 150. Although a generally rectangular shape is illustrated, any suitable shape or style may be adapted to form the structure of cabinet 150. Within cabinet 150, an internal liner of cabinet 150 defines a cooking chamber 166 for receipt of food items for cooking.

A microwave oven enclosure 162 may be supported within cabinet 150. Microwave oven enclosure 162 comprises a first side wall 190 laterally spaced from the first external side panel 176. The first side wall 190 defines a first fan inlet 192 formed as an opening in the first side wall 190. As illustrated, the first fan inlet 192 may be formed by removing a portion of the first side wall 190. In other embodiments, the first fan inlet 192 may be a series of smaller openings, for example holes or slots, formed in the first side wall 190 to allow a flow of air to pass.

Microwave oven enclosure 162 comprises a second side wall 194 laterally spaced from the second external side panel 178. The second side wall 194 also defines a fan inlet, second fan inlet 196 formed, as above, as an opening in the second side wall 194. Also as above, the second fan inlet 196 may be formed by removing a portion of the second side wall 194 or, in some embodiments, may be a series of smaller openings, for example holes or slots, formed in the second side wall 194 to allow a flow of air to pass. The microwave oven enclosure 162 may also comprise a bottom panel 198 joining the first side wall 190 and the second side wall 194 at a lower end of each wall.

Microwave appliance 102 is generally configured to heat articles (e.g., food or beverages) within cooking chamber 166 using electromagnetic radiation. Microwave appliance 102 may include various components which operate to produce electromagnetic radiation, as is generally understood. For example, microwave appliance 102 may include a heating assembly 168 in mechanical space 200, the heating assembly 168 having a magnetron (e.g., a cavity magnetron), a high voltage transformer, a high voltage capacitor, and a high voltage diode, as is understood. The transformer may provide energy from a suitable energy source (such as an electrical outlet) to the magnetron. The magnetron may convert the energy to electromagnetic radiation, specifically microwave radiation. The capacitor generally connects the magnetron and transformer, such as via high voltage diode, to a chassis. Microwave radiation produced by the magnetron may be transmitted through a waveguide to cooking chamber 166.

The structure and intended function of microwave ovens or appliances are generally understood by those of ordinary skill in the art and are not described in further detail herein.

Microwave appliance 102 may include a door assembly 170 that is movably mounted (e.g., rotatably attached) to cabinet 150 in order to permit selective access to cooking chamber 166. Specifically, door assembly 170 may move between an open position (not pictured) and a closed position (e.g., FIG. 1). The open position permits access to cooking chamber 166 while the closed position restricts access to cooking chamber 166. The handle 172 may be mounted to or formed on door assembly 170 to assist a user with opening and closing door assembly 170.

Kitchen hub 100 may include a ventilation system 202. Ventilation system 202 may include an air handler (or fan) 212. For instance, air handler 212 may be provided within microwave appliance 102. As such, microwave appliance 102 may be referred to as a casing of air handler 212. However, according to additional or alternative embodiments, air handler 212 may be positioned within a separate and distinct casing 203 (e.g., schematically shown in FIG. 3). In the instance where ventilation system 202 is for a bathroom (or provided separately from kitchen hub 100), air handler 212 may be positioned within a casing 203 defined in a wall of the room. However, it should be understood that any suitable casing 203 for air handler 212 may be incorporated, and the disclosure is not limited to the examples provided herein.

Figure 2:
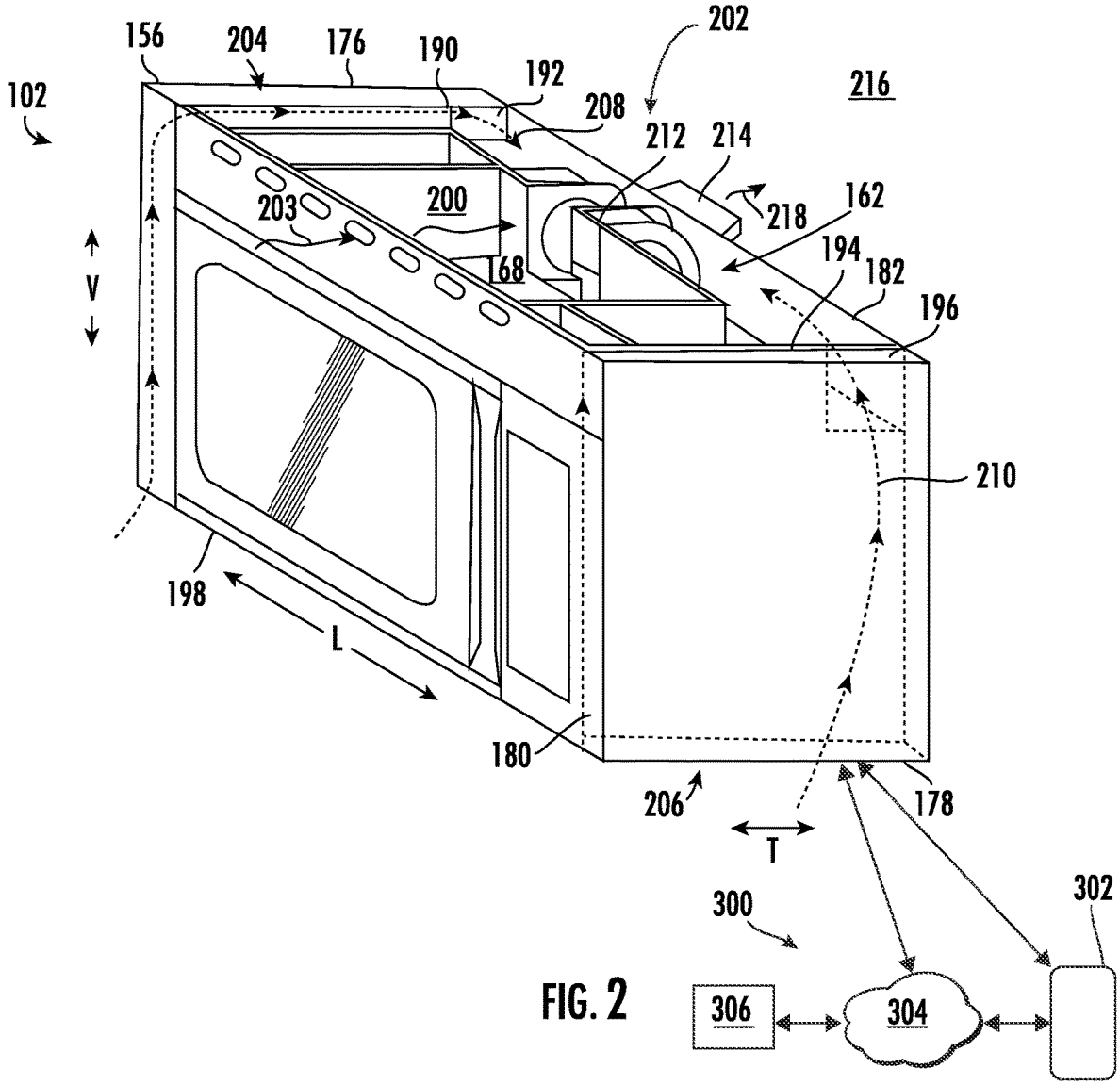
FIG. 2 is a partially exploded perspective view of an over the range microwave with ventilation in accordance with the present disclosure.

As described above and illustrated at least in FIG. 2, the first side wall 190, the first external side panel 176, the front panel 180, the back panel 182, and the top panel 184 may define a first duct 204. Similarly, the second side wall 194, the second external side panel 178, the front panel 180, the back panel 182, and the top panel 184 may define a second duct 206. Ducts 204, 206 may be open at the bottom 154 of the cabinet 150 and closed at the upper end by top panel 184. First fan inlet 192 may provide an outlet to first duct 204 and together, first duct 204 and first fan inlet 192 may define a first exhaust path 208 (FIG. 2). Similarly, second fan inlet 196 may provide an outlet to second duct 206, and second duct 206 and second fan inlet 196 may cooperate to define a second exhaust path 210 (FIG. 2).

First exhaust path 208 and second exhaust path 210 may be in fluid communication with air handler (or fan) 212 mounted in cabinet 150. As illustrated, air handler 212 may be positioned adjacent to the back panel 182 of cabinet 150. For instance, air handler 212 may be positioned or accommodated within casing 203 (FIG. 3). The location of air handler 212 may be any suitable location facilitating a flow of air through the first and second exhaust paths 208, 210. In an embodiment, air handler 212 draws air in from the first duct 204 and the second duct 206 forming first and second exhaust paths 208, 210, respectively. The exhaust paths 208, 210 may be combined at air handler 212 to form exhaust 218 which, in an embodiment, flows through an exhaust vent 214 to the external atmosphere 216. Accordingly, the combined exhaust 218 may include first and second ducts 204, 206, first and second fan inlets 192, 196, fan 212, and the exhaust vent 214.

According to the illustrated exemplary embodiment, air handler 212 is an axial fan positioned within casing 151. However, it should be appreciated that according to alternative embodiments, air handler 212 may be positioned at any other suitable location and may be any other suitable fan type, such as a tangential fan, a centrifugal fan, etc.

In addition, according to an exemplary embodiment, air handler 212 is a variable speed fan such that it may rotate at different rotational speeds, thereby generating different air flow rates. In this manner, the amount of air circulated through exhaust 218 may be continuously and precisely regulated. Moreover, by pulsing the operation of air handler 212 or throttling air handler 212 between different rotational speeds, the flow of air through exhaust 218 may have a different flow velocity or may generate a different flow pattern within cabinet 150.

Kitchen hub 100 may further include a sensor 220 (e.g., in electrical or wireless communication with controller 130, FIG. 3). During use, the sensor 220 may communicate with the controller 130 to send information to the controller 130. Generally, sensor 220 is configured to detect an air-quality characteristic (e.g., of external atmosphere 216). Thus, sensor 220 may sense an air-quality characteristic within the room in which the appliance (e.g., kitchen hub 100) is provided. Sensor 220 may be located at any appropriate location within the external atmosphere. For example, the sensor 220 may be provided below microwave appliance 102.

Sensor 220 may sense the air-quality characteristic within the external atmosphere 216 after a cooking cycle, during a cooking cycle, or at any predetermined time. The air-quality characteristic may include total volatile organic compounds (tVOC) or equivalent carbon dioxide ($eCO_2$), for example. Sensor 220 may be configured to measure any suitable air-quality characteristic, and the disclosure is not limited to those mentioned herein. Additionally or alternatively, a plurality of sensors 180 may be provided to measure multiple air-quality characteristics (e.g., temperature, humidity, carbon monoxide [CO], smoke, etc.).

Referring back to FIG. 2, a schematic diagram of an external communication system 300 will be described according to an exemplary embodiment of the present subject matter. In general, external communication system 300 is configured for permitting interaction, data transfer, and other communications between kitchen hub 100 (e.g., via controller 130) and one or more external devices. For example, this communication may be used to provide and receive operating parameters, user instructions or notifications, performance characteristics, user preferences, or any other suitable information for improved performance of kitchen hub 100. In addition, it should be appreciated that external communication system 300 may be used to transfer data or other information to improve performance of one or more external devices or appliances and/or improve user interaction with such devices.

For example, external communication system 300 permits controller 130 of kitchen hub 100 to communicate with a separate device external to kitchen hub 100, referred to generally herein as an external device 302. As described in more detail below, these communications may be facilitated using a wired or wireless connection, such as via a network 304. In general, external device 302 may be any suitable device separate from kitchen hub 100 that is configured to provide and/or receive communications, information, data, or commands from a user. In this regard, external device 302 may be, for example, a personal phone, a smartphone, a tablet, a laptop or personal computer, a wearable device, a smart home system, or another mobile or remote device.

In addition, a remote server 306 may be in communication with kitchen hub 100 and/or external device 302 through network 304. In this regard, for example, remote server 306 may be a cloud-based server 306, and is thus located at a distant location, such as in a separate state, country, etc. According to an exemplary embodiment, external device 302 may communicate with a remote server 306 over network 304, such as the Internet, to transmit/receive data or information, provide user inputs, receive user notifications or instructions, interact with or control kitchen hub 100, etc. In addition, external device 302 and remote server 306 may communicate with kitchen hub 100 to communicate similar information.

In general, communication between kitchen hub 100, external device 302, remote server 306, and/or other user devices or appliances may be carried using any type of wired or wireless connection and using any suitable type of communication network, non-limiting examples of which are provided below. For example, external device 302 may be in direct or indirect communication with kitchen hub 100 through any suitable wired or wireless communication connections or interfaces, such as network 304. For example, network 304 may include one or more of a local area network (LAN), a wide area network (WAN), a personal area network (PAN), the Internet, a cellular network, any other suitable short or long-range wireless networks, etc. In addition, communications may be transmitted using any suitable communications devices or protocols, such as via Wi-Fi®, Bluetooth®, Zigbee®, wireless radio, laser, infrared, Ethernet type devices and interfaces, etc. In addition, such communication may use a variety of communication protocols (e.g., TCP/IP, HTTP, SMTP, FTP), encodings or formats (e.g., HTML, XML), and/or protection schemes (e.g., VPN, secure HTTP, SSL).

External communication system 300 is described herein according to an exemplary embodiment of the present subject matter. However, it should be appreciated that the exemplary functions and configurations of external communication system 300 provided herein are used only as examples to facilitate description of aspects of the present subject matter. System configurations may vary, other communication devices may be used to communicate directly or indirectly with one or more associated appliances, other communication protocols and steps may be implemented, etc. These variations and modifications are contemplated as within the scope of the present subject matter.

Figure 4:
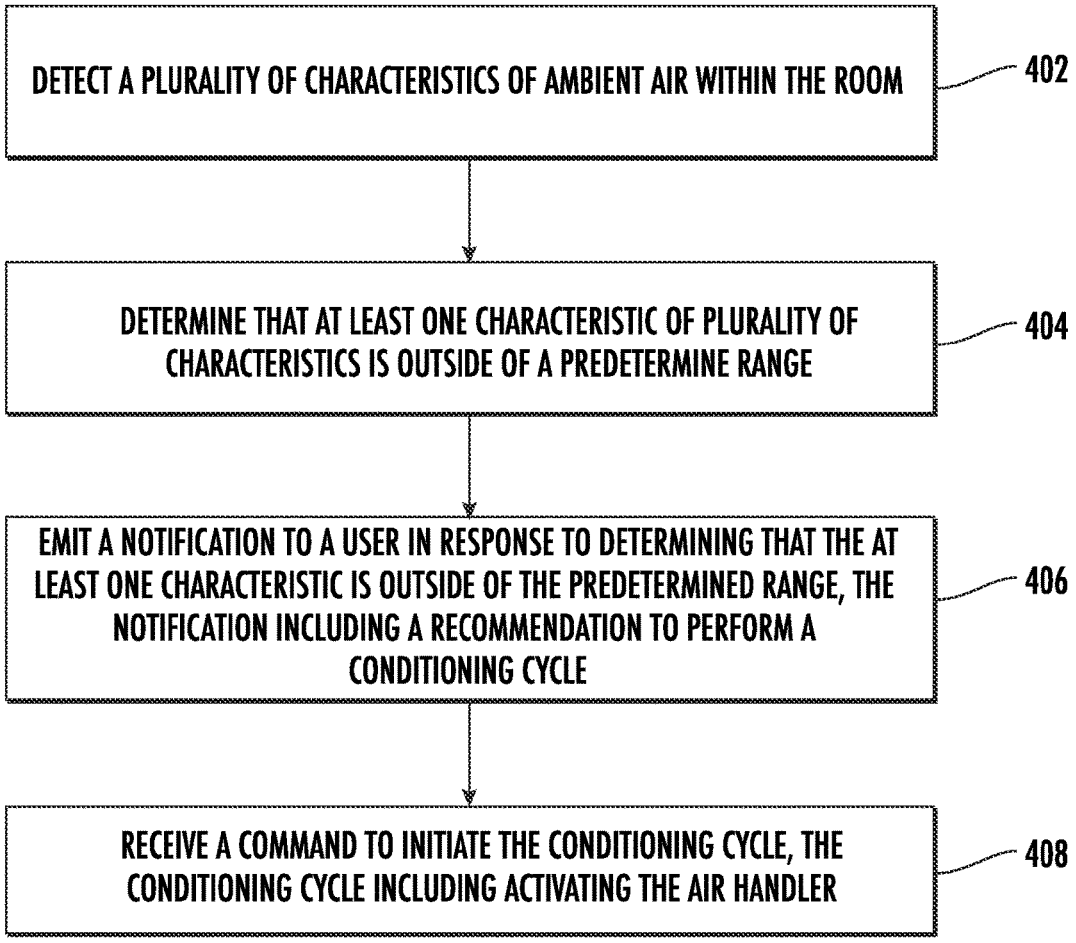
FIG. 4 provides a flow chart illustrating a method of operating an appliance according to exemplary embodiments of the present disclosure.

Referring now to FIG. 4, a method 400 of operating a ventilation system (e.g., ventilation system 202) will be described in detail. Method 400 may be applied to ventilation system 202 of kitchen hub 100 described above, or to any suitable ventilation system including an air handler, a sensor, and a controller. The steps described herein may be performed by controller 130 or by a separate, dedicated controller. The steps presented and described herein may be performed in any suitable order, and may include additional steps or omit certain steps described herein.

At step 402, method 400 may include detecting a plurality of characteristics of ambient air within a room. In detail, method 400 may be initiated at any suitable time, such as during a cooking or heating operation (e.g., with respect to kitchen hub 100). A sensor (e.g., sensor 220) may be activated or otherwise initiated to begin sensing the characteristics within the room (e.g., kitchen, bathroom, etc.). As mentioned above, the plurality of characteristics may include a tVOC level, an $eCO_2$ level, a smoke level or concentration, a humidity level, a moisture level, a CO level, or the like. Accordingly, two or more sensors may be incorporated to detect and monitor each of the plurality of characteristics.

The sensor or sensors may continually monitor the ambient air to detect changes in one or more of the plurality of characteristics. For instance, the sensor may be in an "always on" state, comparing current levels of the plurality of characteristics to predetermined levels. In additional or alternative embodiments, the sensor may be programmed to perform readings or measurements at predetermined intervals (e.g., every 10 seconds). As described above, the sensor may be operably coupled with a controller (e.g., controller 130) to which the readings or detections are then sent.

At step 404, method 400 may include determining that at least one characteristic of the plurality of characteristics is outside of a predetermined range. For instance, during the measurement cycle, method 400 may determine (e.g., according to the received data from the sensor) that at least one characteristic of the plurality of characteristics is abnormal (e.g., outside of the normal range). An abnormal characteristic may include a high level of tVOC, a high level of CO, a high concentration of smoke, a high moisture level, or the like. In some instances, the abnormality may be a low level of the respective characteristic.

According to some embodiments, determining that the at least one characteristic is outside of the predetermined range includes determining that the at least one characteristic has reached a predetermined threshold. As mentioned, the abnormality may be a high level of the at least one characteristic. Accordingly, a user may define a threshold at which the characteristic is determined to be abnormal. In some instances, the threshold is predetermined (e.g., set during manufacturing or by a seller). Thus, the at least one characteristic may be determined to be outside of the predetermined range when the threshold (e.g., concentration of the characteristic) is crossed.

At step 406, method 400 may include emitting a notification to a user in response to determining that the at least one characteristic is outside of the predetermined range. In detail, method 400 may provide a notification or alert to notify a user as to the air quality within the room. The notification may be emitted via a user interface (e.g., user interface panel 126). For instance, the notification may be presented on a display of the user interface. Additionally or alternatively, the notification may be provided to a remote device (e.g., external device 302) such as a smartphone, tablet, wearable, or the like. For instance, method 400 may include establishing a remote connection with the remote device (e.g., via a local network). The notification may then be sent to the remote device via the network. The notification may include a textual or visual notification (e.g., such as a string of words presenting the notification) along with an audible notification (e.g., such as an alarm, a buzzer, or the like).

The notification may include one or more recommendations. In detail, the notification may alert the user as to the status of the air currently within the room (e.g., kitchen, bathroom, etc.). The notification may thus include an analysis of the at least one characteristic (or each of the plurality of characteristics). For one example, the notification may present a current reading including the current levels of each of the plurality of characteristics. The notification may show the levels as compared to the normal levels (e.g., as part of a range or as compared to the threshold). Additionally or alternatively, the notification may include educational pointers on the characteristics which are currently measuring as abnormal. Advantageously, the user may be informed as to preferred levels and air quality standards as the air quality event unfolds.

According to some embodiments, the notification includes a recommendation to perform a conditioning cycle. In detail, method 400 may determine that the at least one characteristic is at a predetermined level such that the conditioning cycle would improve the air quality to an optimal degree. For instance, method 400 may determine that the moisture level of the ambient air is above the threshold (or outside of the predetermined range) and determine that the conditioning cycle would benefit the user in comfort and functionality. The notification may thus inform the user that the conditioning cycle is recommended to improve the quality of the air.

At step 408, method 400 may include receiving a command to initiate the conditioning cycle. Upon emitting the notification to the user, the appliance may wait to receive the initiation command before initiating any conditioning operation. Accordingly, the appliance may refrain from automatically activating any elements (e.g., such as the air handler) to perform the conditioning operation. The command (e.g., initiation command) may be performed or input by the user. For instance, the user may decide that the conditioning cycle is required (or desired) and may initiate the conditioning cycle (e.g., via the user input or via the connected remote device).

The conditioning cycle may include activating the air handler. As described above, the air handler may be a variable speed air handler or fan capable of operating (e.g., rotating) at a plurality of speeds to produce varying airflows. Thus, the initiation of the conditioning cycle may include activating the air handler at a first predetermined speed. The first predetermined speed may depend on the at least one characteristic which is outside of the predetermined range, the amount to which the at least one characteristic is outside of the predetermined range, a number of characteristics which are outside of the predetermined range, a combination of factors, or the like. Moreover, the first predetermined speed may depend on a time of day, a time of year, or the like. Further still, the first predetermined speed may depend on an operation of additional connected devices (e.g., a central air conditioning unit within the structure). Thus, the conditioning cycle may be initiated according to an input by the user after having provided the notification to the user regarding the air quality.

Method 400 may include determining a corresponding recommended trigger point to initiate the conditioning cycle. For instance, a plurality of recommended trigger points may be determined, each respectively matched with one of the plurality of characteristics. For one example, a smoke level or concentration within the ambient air may have a first recommended trigger point (e.g., above a predetermined parts per million [ppm]). The recommended trigger point may thus be a threshold. The recommended trigger point may thus include the recommendation to initiate the conditioning cycle. The recommended trigger points may be determined before an air quality event takes place. For instance, upon an initial set up of the appliance (e.g., kitchen hub, microwave, bathroom fan, etc.), the operating system of the appliance may provide the prompt to the user to set the trigger points (e.g., according to the recommendations). Accordingly, in subsequent air quality events, the appliance may determine an activation point according to the preselected and preset trigger points.

Method 400 may include presenting a list of each of the corresponding recommended trigger points to the user. For instance, the list may be presented on the user interface of the appliance. Additionally or alternatively, the list may be forwarded or sent to the remote device (e.g., in remote communication with the appliance). The user may then select to incorporate one or more of the recommended trigger points. When a corresponding recommended trigger point is selected, method 400 may store the selection within an on-board memory. Subsequently, when the selected trigger point is reached in the future, the appliance may perform a predetermined response (e.g., as a response to the at least one characteristic reaching the stored trigger point). Thus, the user may select a trigger point only according to one or some of the plurality of characteristics (e.g., smoke level, CO level, etc.). The conditioning cycle will not automatically initiated if another (e.g., unselected) characteristic is triggered in future operations.

For one example, method 400 may include prompting the user to set an automatic response (e.g., after emitting the notification to the user at step 406). The prompt may include a request to automatically initiate the conditioning cycle when at least one of the characteristics reaches the stored recommended trigger. The user may then respond to the prompt (or request) in the affirmative to set the automatic response. Accordingly, method 400 may include receiving a command to establish the automatic response. From here, method 400 may include storing the automatic response after receiving the command. As mentioned, the automatic response may include initiating the air handler at a predetermined speed. According to some embodiments, the predetermined speed may be the first predetermined speed, a second predetermined speed, or the like. Accordingly, the conditioning cycle may be initiated upon determining that at least one characteristic of the plurality of characteristics is outside of the predetermined range.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A ventilation system comprising:

a casing defining a receiving space and an air outlet;

an air handler positioned within the casing and configured to motivate an airflow through the air outlet to condition a room; and a controller operably coupled with the air handler, the controller configured to perform an operation, the operation comprising:

detecting a plurality of characteristics of ambient air within the room;

determining that at least one characteristic of the plurality of characteristics is outside of a predetermined range, wherein determining that the at least one characteristic is outside of the predetermined range comprises determining that the at least one characteristic has reached a predetermined threshold, the predetermined threshold being dictated according to user input;

emitting a notification to a user in response to determining that the at least one characteristic is outside of the predetermined range, wherein the notification comprises a recommendation to a user to perform a conditioning cycle; and receiving a command to initiate the conditioning cycle, wherein the conditioning cycle comprises activating the air handler.

2. The ventilation system of claim 1, further comprising:

at least one sensor positioned within the room, the at least one sensor configured to monitor the plurality of characteristics of the ambient air within the room.

3. The ventilation system of claim 1, wherein the plurality of characteristics comprises at least two of a humidity level, a smoke concentration, a carbon dioxide concentration, a total volatile organic compound (tVOC) concentration, and a carbon monoxide concentration.

4. The ventilation system of claim 1, wherein emitting the notification to the user further comprises:

presenting an analysis of the at least one characteristic outside of the predetermined range.

5. The ventilation system of claim 4, wherein the operation further comprises:

determining a corresponding recommended trigger point to initiate the conditioning cycle according to each of the plurality of characteristics; and presenting a list of each of the corresponding recommended trigger points to the user.

6. The ventilation system of claim 1, wherein the operation further comprises:

prompting the user to set an automatic response after emitting the notification to the user;

receiving a command to establish the automatic response; and storing the automatic response in response to receiving the command, wherein the automatic response comprises initiating the air handler at a predetermined speed upon determining that the at least one characteristic is outside of the predetermined range.

7. The ventilation system of claim 1, further comprising:

a user interface provided on the casing, the user interface comprising a user input panel and a display, wherein emitting the notification to the user comprises:

displaying the notification via the display on the user interface.

8. The ventilation system of claim 1, wherein emitting the notification to the user comprises:

establishing a remote connection with a remote device; and emitting the notification to the remote device, wherein the remote device comprises a smartphone.

9. A method of operating a ventilation system provided within a room, the ventilation system comprising a casing and an air handler positioned within the casing, the method comprising:

detecting a plurality of characteristics of ambient air within the room;

determining that at least one characteristic of the plurality of characteristics is outside of a predetermined range, wherein determining that the at least one characteristic is outside of the predetermined range comprises determining that the at least one characteristic has reached a predetermined threshold, the predetermined threshold being dictated according to user input;

emitting a notification to a user in response to determining that the at least one characteristic is outside of the predetermined range, wherein the notification comprises a recommendation to a user to perform a conditioning cycle; and receiving a command to initiate the conditioning cycle, wherein the conditioning cycle comprises activating the air handler.

10. The method of claim 9, wherein the ventilation system further comprises:

at least one sensor positioned within the room, the at least one sensor configured to monitor the plurality of characteristics of the ambient air within the room.

11. The method of claim 9, wherein the plurality of characteristics comprises at least two of a humidity level, a smoke concentration, a carbon dioxide concentration, a total volatile organic compound (tVOC) concentration, and a carbon monoxide concentration.

12. The method of claim 9, wherein emitting the notification to the user further comprises:

presenting an analysis of the at least one characteristic outside of the predetermined range.

13. The method of claim 12, further comprising:

determining a corresponding recommended trigger point to initiate the conditioning cycle according to each of the plurality of characteristics; and presenting a list of each of the corresponding recommended trigger points to the user.

14. The method of claim 9, further comprising:

prompting the user to set an automatic response after emitting the notification to the user;

receiving a command to establish the automatic response; and storing the automatic response in response to receiving the command, wherein the automatic response comprises initiating the air handler at a predetermined speed upon determining that the at least one characteristic is outside of the predetermined range.

15. The method of claim 9, wherein the ventilation system further comprises:

a user interface provided on the casing, the user interface comprising a user input panel and a display, wherein emitting the notification to the user comprises:

displaying the notification via the display on the user interface.

16. The method of claim 9, wherein emitting the notification to the user comprises:

establishing a remote connection with a remote device; and emitting the notification to the remote device, wherein the remote device comprises a smartphone.

17. A ventilation system comprising:

a casing defining a receiving space and an air outlet;

an air handler positioned within the casing and configured to motivate an airflow through the air outlet to condition a room; and a controller operably coupled with the air handler, the controller configured to perform an operation, the operation comprising:

detecting a plurality of characteristics of ambient air within the room;

determining that at least one characteristic of the plurality of characteristics is outside of a predetermined range;

emitting a notification to a user in response to determining that the at least one characteristic is outside of the predetermined range, wherein the notification comprises a recommendation to perform a conditioning cycle;

prompting the user to set an automatic response after emitting the notification to the user;

receiving a command to establish the automatic response;

storing the automatic response in response to receiving the command to establish the automatic response, wherein the automatic response comprises initiating the air handler at a predetermined speed upon determining that the at least one characteristic is outside of the predetermined range; and receiving a command to initiate the conditioning cycle, wherein the conditioning cycle comprises activating the air handler.

* * * * *